US010464068B2

(12) United States Patent
Sjöström et al.

(10) Patent No.: US 10,464,068 B2
(45) Date of Patent: Nov. 5, 2019

(54) BLADE ELEMENT FOR REFINER

(71) Applicant: VALMET TECHNOLOGIES OY, Espoo (FI)

(72) Inventors: Håkan Sjöström, Espoo (FI); Matti Kaarineva, Espoo (FI); Tomi Iisakkila, Espoo (FI); Marko Loijas, Espoo (FI); Marcus Sjölund, Espoo (FI); Karl Lönngren, Espoo (FI)

(73) Assignee: VALMET TECHNOLOGIES OY, Espoo (FI)

( * ) Notice: Subject to any disclaimer, the term of this patent is extended or adjusted under 35 U.S.C. 154(b) by 296 days.

(21) Appl. No.: 15/523,350

(22) PCT Filed: Oct. 23, 2015

(86) PCT No.: PCT/FI2015/050725
§ 371 (c)(1),
(2) Date: Apr. 28, 2017

(87) PCT Pub. No.: WO2016/066894
PCT Pub. Date: May 6, 2016

(65) Prior Publication Data

US 2017/0320063 A1 Nov. 9, 2017

(30) Foreign Application Priority Data

Oct. 29, 2014 (FI) ..... 20145948

(51) Int. Cl.
*B02C 17/00* (2006.01)
*B02C 7/12* (2006.01)
*D21D 1/30* (2006.01)

(52) U.S. Cl.
CPC ..... *B02C 7/12* (2013.01); *D21D 1/306* (2013.01); *D21D 1/30* (2013.01)

(58) Field of Classification Search
CPC ..... B02C 7/12; D21D 1/30; D21D 1/306
(Continued)

(56) References Cited

U.S. PATENT DOCUMENTS 285,118 A * 9/1883 Ethell ..... B02C 7/12 241/296
294,911 A * 3/1884 Prior ..... B02C 7/12 241/296

(Continued)

FOREIGN PATENT DOCUMENTS

DE 202004003743 U1 5/2004
DE 102008039001 A1 2/2010

(Continued)

OTHER PUBLICATIONS

International Search Report for PCT/FI2015/050725 dated Feb. 2, 2016.

(Continued)

*Primary Examiner* — Faye Francis
(74) *Attorney, Agent, or Firm* — Stiennon & Stiennon

(57) ABSTRACT

A blade element (12) for a refiner (10, 11) for refining fibrous material has an inner edge (13) and an outer edge (14) and first blade bars (18) and first blade grooves (19) therebetween, the first blade bars and the first blade grooves extending toward the outer edge of the blade element. At top surfaces of the first blade bars there are second blade bars (20) and second blade grooves (21) therebetween. At least some of the second blade bars (20) lying on an outer end portion (12*b*) of the blade element (12) have a width which is larger than a width of second blade bars (20) lying on an inner end portion (12*a*) of the blade element (12) and/or is increasing in direction toward the outer edge (14) of the blade element (12).

20 Claims, 2 Drawing Sheets

(58) Field of Classification Search
USPC ..... 241/261.3
See application file for complete search history.

(56) References Cited

U.S. PATENT DOCUMENTS

| | | | | | |
|---|---|---|---|---|---|
| 1,368,609 | A * | 2/1921 | Czarev | B02C 7/12 | 241/298 |
| 1,705,996 | A * | 3/1929 | Pope | B02C 7/12 | 241/259.1 |
| 2,654,295 | A * | 10/1953 | Sutherland | B02C 7/12 | 241/245 |
| 3,462,089 | A * | 8/1969 | Whitlow | B02C 7/12 | 241/296 |
| 4,023,737 | A * | 5/1977 | Leider | B02C 7/12 | 241/261.3 |
| 4,039,154 | A | 8/1977 | Peterson | | |
| 4,351,489 | A * | 9/1982 | Laptev | D21D 1/306 | 241/261.3 |
| 5,112,443 | A * | 5/1992 | Virving | D21D 1/306 | 162/23 |
| 5,181,664 | A * | 1/1993 | Kohler | B02C 7/12 | 241/261.3 |
| 5,975,438 | A * | 11/1999 | Garasimowicz | B02C 7/12 | 241/15 |
| 6,311,907 | B1 * | 11/2001 | Gingras | B02C 7/12 | 241/261.3 |
| 7,191,967 | B2 * | 3/2007 | Vuorio | B02C 7/12 | 241/261.3 |
| 7,407,123 | B2 | 8/2008 | Antensteiner | | |
| 7,419,112 | B2 * | 9/2008 | Sjostrom | B02C 7/12 | 241/261.3 |
| 7,445,174 | B2 * | 11/2008 | Virving | B02C 7/12 | 241/261.3 |
| 7,913,942 | B2 * | 3/2011 | Vuorio | D21D 1/306 | 241/261.2 |
| 2008/0302897 | A1 * | 12/2008 | Sjostrom | B02C 7/12 | 241/298 |
| 2016/0145798 | A1 | 5/2016 | Sjöström et al. | | |

FOREIGN PATENT DOCUMENTS

| | | | |
|---|---|---|---|
| DE | 102010003582 | A1 | 10/2011 |
| GB | 1556925 | A | 12/1979 |
| WO | 03090931 | A1 | 11/2003 |
| WO | 2005032720 | A1 | 4/2005 |
| WO | 2007065971 | A1 | 6/2007 |
| WO | 2011107339 | A1 | 9/2011 |
| WO | 2012101331 | A1 | 8/2012 |

OTHER PUBLICATIONS

Written Opinion of the International Searching Authority for PCT/FI2015/050725 dated Feb. 2, 2016.

Supplementary European Search Report for EP15854478 dated Apr. 16, 2018.

* cited by examiner

BLADE ELEMENT FOR REFINER

CROSS REFERENCES TO RELATED APPLICATIONS

This application is a US national phase of PCT/FI2015/050725 filed on Oct. 23, 2015 and claims priority on FI 20145948 flied on Oct. 29, 2014 both of which are incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a blade element for a refiner for refining fibrous material, the blade element comprising an inner edge and an outer edge, first blade bars and first blade grooves therebetween, the first blade bars and the first blade grooves extending toward the outer edge of the blade element, and at top surfaces of the first blade bars, second blade bars and second blade grooves therebetween, the second blade bars and the second blade grooves being at least partly transversal to the first blade bars, whereby the second blade bars and the second blade grooves alternate in a direction of the first blade bars.

The invention relates also to a refiner for refining fibrous material.

An example of the blade element as disclosed above is presented in WO-publication 2012/101331 A1.

A problem with these kind of blade elements is a higher wear rate of the blade bars in the vicinity of the outer edge than in the vicinity of the inner edge, which is originated from the higher circumferential speed in the vicinity of the outer edge than in the vicinity of the inner edge, because shearing forces, which affect on the wear rate of the blade bars, are dependent on the circumferential speed and a width of the blade gap between opposing refining elements of the refiner. The wear rate of the blade bars in the vicinity of the outer edge may be double to that in the vicinity of the inner edge. The higher wear rate in the vicinity of the outer edge may result in the blade bars in the vicinity of the inner edge to run into contact, causing fiber cutting and increased vibration levels in the refiner.

BRIEF DESCRIPTION OF THE INVENTION

An object of the present invention is to provide a novel blade element for a refiner for refining fibrous material.

The blade element according to the invention is characterized in that at least some of the second blade bars lying on the outer end portion of the blade element have a width which is larger than a width of second blade bars lying on the inner end portion of the blade element and/or which is increasing in direction toward the outer edge of the blade element.

The refiner according to the invention is characterized in that the refiner comprises at least one blade element as claimed in any one of claims 1 to 13.

The widths of at least some of the second blade bars located close to the outer edge of the blade element are dimensioned to be larger than the widths of the second blade bars locating closer to the inner edge of the blade element, and/or the width of at least some of the second blade bars located close to the outer edge of the blade element increases in direction toward the outer edge of the blade element, i.e. in their longitudinal direction. The wider second blade bars close to the outer edge of the blade element provide an increased wear resistance, or in other words, compensate the increased wear rate appearing close to the outer edge of the blade element during the operation of the refiner.

According to an embodiment of the blade element, the second blade bars and the second blade grooves are at least partly transversal to the first blade bars, whereby the second blade bars and the second blade grooves alternate in a direction of the first blade bars.

According to an embodiment of the blade element, the width of substantially all the second blade bars lying on the outer end portion of the blade element is increasing in direction toward the outer edge of the blade element.

According to an embodiment of the blade element, a width of at least some of the second blade bars lying on the inner end portion of the blade element is increasing in direction toward the outer edge of the blade element.

According to an embodiment of the blade element, the width of substantially all the second blade bars lying on the inner end portion of the blade element are increasing in direction toward the outer edge of the blade element.

According to an embodiment of the blade element, the increase in the width of the second blade bar in its longitudinal direction toward the outer edge of the blade element is 10 to 50%, preferably 30 to 40%.

According to an embodiment of a blade element, the width of the second blade bars is arranged to increase toward the outer edge of the blade element in such a way that the widths of the second blade bars lying closer to an outer edge of the blade element are larger than the widths of the second blade bars lying farther off the outer edge of the blade element.

According to an embodiment of a blade element, the width of the second blade bars is arranged to increase stepwise in such a way that the widths of the second blade bars within a group of neighboring second blade bars are equal but the widths of the second blade bars are largest in such a group which lies closer to the outer edge of the blade element.

According to an embodiment of a blade element, the width of the second blade bars is arranged to increase continuously toward the outer edge of the blade element in such a way that the width of a next second blade bar is higher than the width of a preceding second blade bar in a direction of the first blade bar toward the outer edge of the blade element.

According to an embodiment of a blade element, an increase in the width of the second blade bars between the second blade bars lying on the outer end portion of the blade element and the second blade bars lying on the inner end portion of the blade element is 10-100%, preferably 10 to 50% and more preferably 30 to 40%.

According to an embodiment of a blade element, the blade element is a planar-like blade element intended to a disc refiner and that an increase in the width of the second blade bars is 0.5 mm to 0.7 mm.

According to an embodiment of a blade element, the width of the second blade bar lying near the inner edge of the blade element is 1-2 mm and the width of the second blade bar lying near the outer edge of the blade element is 1.5-2.7 mm.

According to an embodiment of a blade element, the blade element is a conical blade element intended to a cone refiner and an increase in the width of the second blade bars is 0.1 mm to 0.3 mm.

According to an embodiment of a blade element, the width of the second blade bar lying near the inner edge of the blade element is arranged to vary between 1.3 mm and 1.4 mm and the width of the second blade bar lying near the outer edge of the blade element is arranged to vary between 1.5 mm and 1.7 mm.

BRIEF DESCRIPTION OF THE DRAWINGS

In the following, the invention will be described in greater detail by means of preferred embodiments with reference to the accompanying drawings, in which.

For the sake of clarity, the figures show some embodiments of the invention in a simplified manner. Like reference numerals identify like elements in the figures.

DESCRIPTION OF THE PREFERRED EMBODIMENTS

Figure 1:
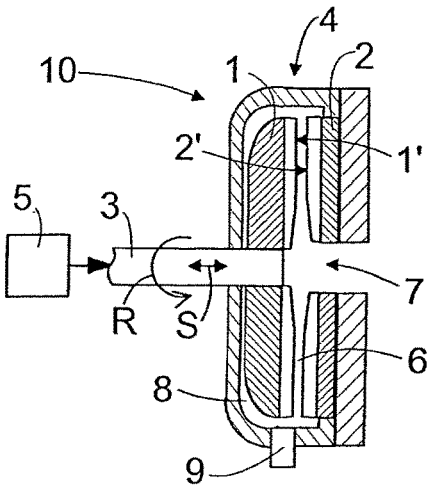
FIG. 1 is a schematic cross-sectional side view of a disc refiner.

FIG. 1 schematically shows a cross-sectional side view of a disc refiner 10. The disc refiner 10 of FIG. 1 comprises a disc-like first refining element 1 and a disc-like second refining element 2. The first refining element 1 includes a first refining surface V and the second refining element 2 includes a second refining surface 2'. The first refining element 1 and the second refining element 2 are arranged coaxially to one another such that the first refining surface V and the second refining surface 2' will be substantially opposite to one another. In the disc refiner 10 of FIG. 1 the first refining element 1 is arranged rotatable by a shaft 3, for instance, in the direction of arrow R shown schematically in FIG. 1, the first refining element 1 thus constituting a rotor 1 of the disc refiner 10. For the sake of clarity, FIG. 1 does not show the motor used for rotating the first refining element 1, which motor may be implemented in manners obvious to a person skilled in the art. Further, in the disc refiner 10 of FIG. 1 the second refining element 2 is fixedly supported to a frame structure 4 of the disc refiner 10, the second refining element 2 thus constituting a stator 2 of the refiner 10. Thus, as the first refining element 1 rotates, when the refiner 10 is in operation, the first refining surface 1' and the second refining surface 2' are arranged to move in relation to one another. FIG. 1 further shows a loading device 5, which is coupled to act through a shaft 3 on the first refining element 1 such that the first refining element 1 may be transferred toward the second refining element 2 or away therefrom, as schematically indicated by arrow S, so as to adjust a gap 6 between the first refining element 1 and the second refining element 2, i.e. the blade gap 6.

In the disc refiner 10 of FIG. 1 fibrous, lignocellulose-containing material to be defibrated or refined may be fed through an opening 7 in the middle of the second refining element 2 into a blade gap 6 between the refining surfaces 1' and 2', where it is defibrated and refined while the water contained in the material vaporizes. The material to be defibrated may also be fed into the blade gap 6 through openings in the first refining surface 1' and/or the second refining surface 2', which openings are not shown in FIG. 1 for the sake of clarity. Defibrated material exits the blade gap 6 from its outer edge to a refining chamber 8 of the refiner 10 and further out of the refining chamber 8 through a discharge channel 9. In some disc refiners the material to be defibrated may be fed into the blade gap 6 through openings arranged in the first refining surface 1' or in the second refining surface 2', and the material already defibrated may be discharged out of the blade gap 6 through openings arranged in the opposite refining surface, which openings are not shown in FIG. 1 for the sake of clarity.

Figure 2:
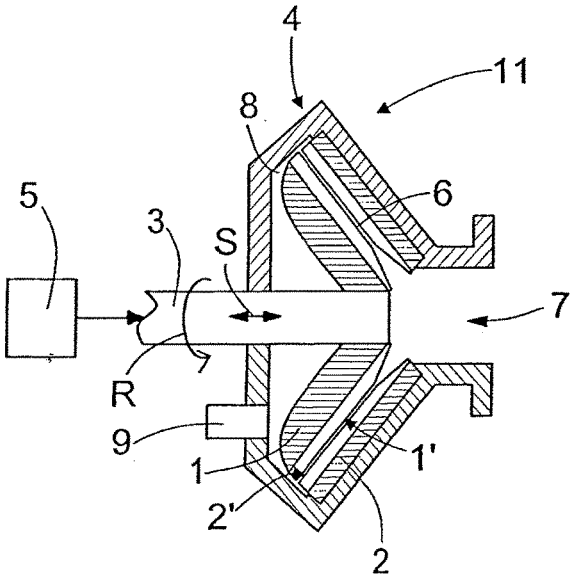
FIG. 2 is a schematic cross-sectional side view of a cone refiner.

FIG. 2 schematically shows a cross-sectional side view of a cone refiner 11. The cone refiner 11 of FIG. 2 comprises corresponding parts as the disc refiner 10 of FIG. 2, the main difference being only the shape of the refining elements which are conical in the cone refiner 11. Fibrous, lignocellulose-containing material to be defibrated or refined may be fed through an opening 7 in the middle of the second refining element 2 into a blade gap 6 between the refining surfaces 1' and 2', where it is defibrated and refined while the water contained in the material vaporizes. Defibrated material exits the blade gap 6 from its outer edge to a refining chamber 8 of the refiner 11 and further out of the refining chamber 8 through a discharge channel 9. In some cone refiners the material to be defibrated may be fed into the blade gap 6 through openings arranged in the first refining surface 1 ‘ or in the second refining surface 2', and the material already defibrated may be discharged out of the blade gap 6 through openings arranged in the opposite refining surface, which openings are not shown in FIG. 2 for the sake of clarity.

Figure 4:
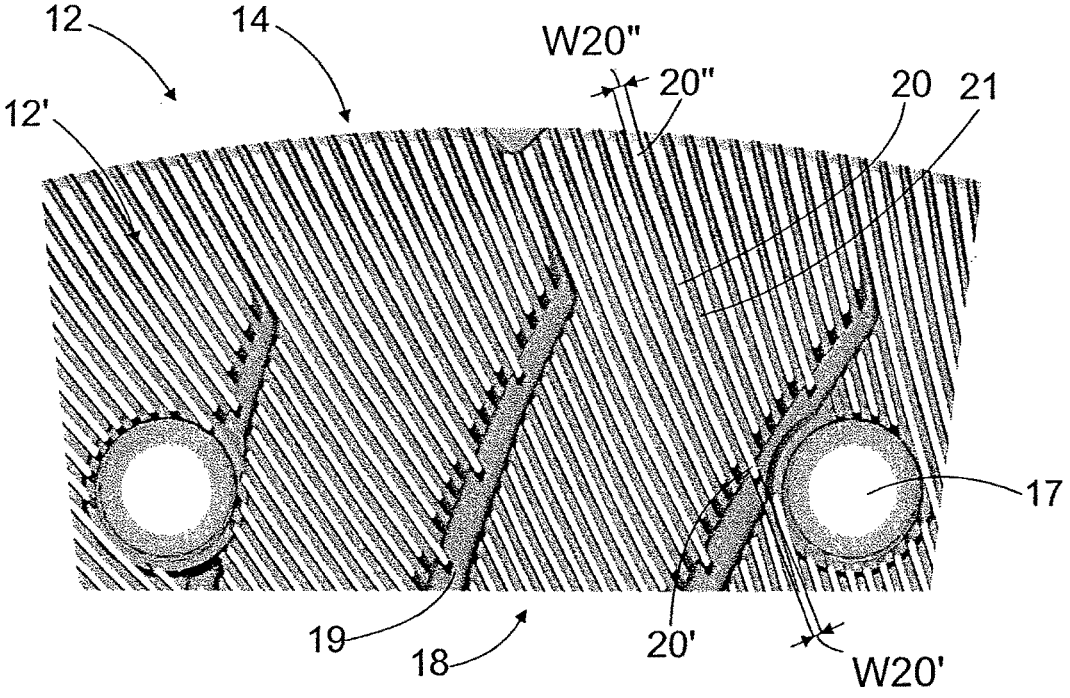
FIG. 4 is a schematic view of a portion of the planar-like blade element of FIG. 3.
Figure 3:
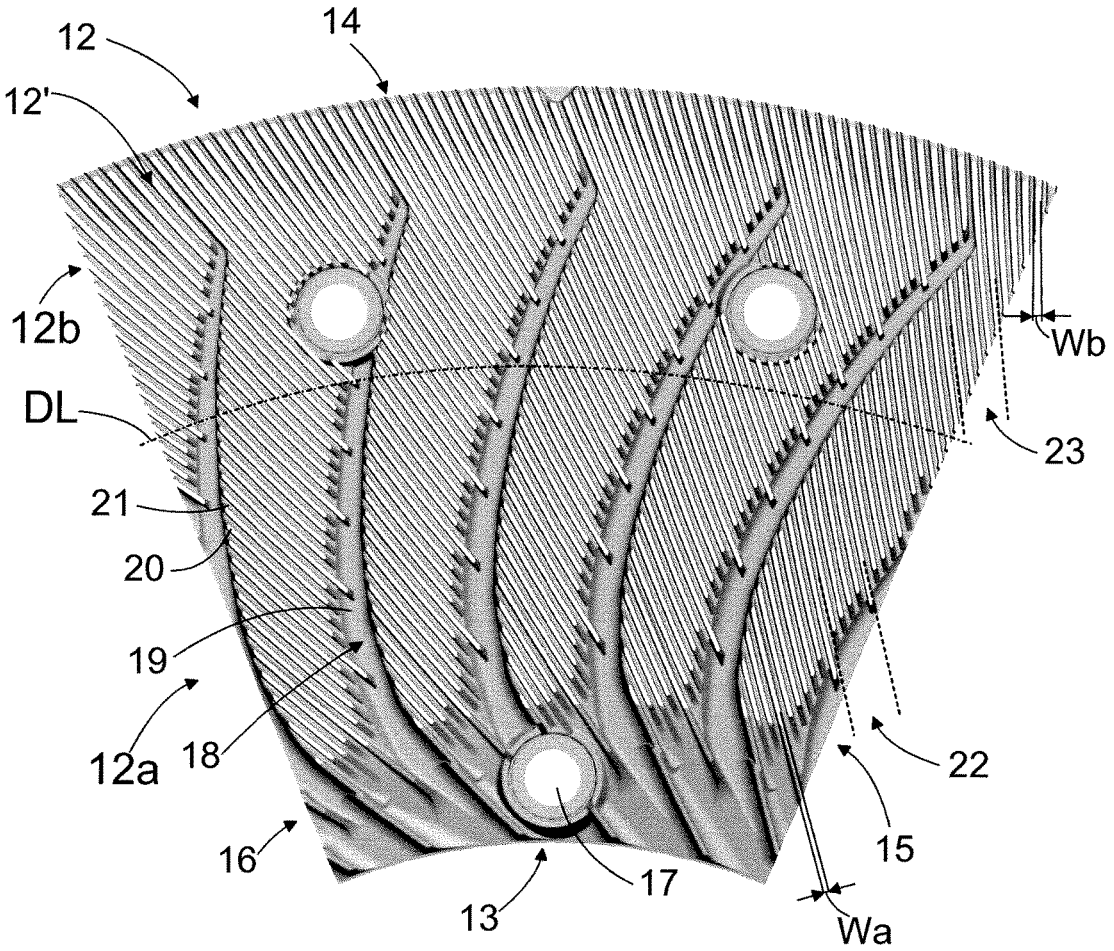
FIG. 3 is a schematic view of a planar-like blade element.

FIG. 3 shows a schematic view of a planar-like or disc-like blade element 12, as seen in a direction of a refining surface 12' of the blade element 12. The blade element 12 of FIG. 3 is a blade segment intended to provide a part of the first 1 or second 2 refining element of the disc refiner 10, whereby the refining surface 12' of the blade element 12 provides a part of the refining surface 1' of the first refining element 1 or of the refining surface 2' of the second refining element 2, and a complete refining surface 1', 2' of the refining element 1, 2 may be provided by placing a number of the blade segments shown next to each other. FIG. 4 is an enlarged schematic view of a portion of the planar-like blade element of FIG. 3.

The blade element 12 of FIG. 3 comprises a first edge 13 or an inner edge 13 or an inner circumference 13, which in the disc refiner 10 is directed toward a center of the refiner 10. In the cone refiner 11 the inner edge of a conical blade element is directed toward the end of the cone refiner 11 having a smaller diameter. The inner edge 13 of the blade element 12 provides a feed edge of the blade element 12, through which the material to be refined is fed into the blade gap 6 unless it is fed into the blade gap 6 through openings arranged through the blade element 12. The blade element 12 further comprises a second edge 14 or an outer edge 14 or an outer circumference 14, which in the disc refiner 10 is directed toward an outer periphery of the refiner 10. In the cone refiner 11 the outer edge of a conical blade element is directed toward the end of the cone refiner 11 having a larger diameter. The outer edge 14 of the blade element 12 provides a discharge edge of the blade element 12, through which the material already refined is discharged out of the blade gap 6 unless it is discharged out of the blade gap 6 through openings arranged through the blade element 12. Further the blade element 12 has a first side edge 15 and a second side edge 16. The blade element 12 is fastened to the respective refining element with fastening means, such as bolts, inserted through fastening holes 17.

The blade element 12 comprises first blade bars 18 extending toward the outer edge 14 of the blade element 12, or in other words, first blade bars 18 extending or running or traveling in a direction from the inner edge 13 toward the outer edge 14. The direction of the first blade bar 18 at each particular point of the first blade bar 18 is defined with a direction of a center line of the first blade bar 18, or to be more exact, with a direction of a tangent of the center line of the first blade bar 18 at that particular point of the first blade bar 18. The blade element 12 further comprises first blade grooves 19 lying between the first blade bars 18, the first blade grooves 19 intended to convey the material to be refined and the material already refined toward the outer edge 14 of the blade element 12. In the embodiment of the blade element 12 of FIG. 3 the first blade grooves 19 are not arranged to reach to the outer edge 14 of the blade element 12, whereby it may be said that the first blade bars 18 are united at an outer edge 14 of the blade element 12.

The blade element 12 further comprises, at the top surfaces of the first blade bars 18, second blade bars 20, i.e. micro bars, and second blade grooves 21, i.e. micro grooves, therebetween. The second blade bars 20 and the second blade grooves 21 are arranged at the top surfaces of the first blade bars 18 in such a way, that they lie, extend, travel or run in a direction which it at least partly transversal to the direction of the first blade bars 18, or in other words, the second blade bars 20 and the second blade grooves 21 are arranged to lie, extend, travel or run in a direction which deviates from the direction of the first blade bars 18. The second blade bars 20 and the second blade grooves 21 are thus arranged at the top surfaces of the first blade bars 18 in such a way that the second blade bars 20 and the second blade grooves 21 alternate in the direction of the extension of the first blade bars 18. The first blade bars 18, the first blade grooves 19, the second blade bars 20 and the second blade grooves 21 together provide the refining surface 12' of the blade element 12.

The blade element 12 or the refining surface 12' of the blade element 12 comprises in a direction from the inner edge 13 toward the outer edge 14 two successive blade element portions or zones, i.e. an inner end portion 12*a* or an inner end zone 12*a* on the side of the inner edge 13 of the blade element 12 and an outer end portion 12*b* or an outer end zone 12*b* on the side of the outer edge 14 of the blade element 12, separated with an imaginary dividing line drawn with a dot-and-dash line and having a reference sign DL. The outer end portion 12*b* of the blade element 12 means thus the radially outermost portion or zone of the blade element 12. It covers the radial distance from the beginning of an unbroken or continuous second blade bar 20 up to outer edge 14 of the blade element 12 so that the outer end portion 12*b* includes the whole length of all those second blade bars 20 which extend up to the outer edge 14 of the blade element 12. The inner end portion 12*a* or the area outside the outer end portion 12*b* covers the rest of the micro grooved area of the blade element 12, thus no one of the second blade bars 20 lying there extends up to the outer edge 14. In other words, the dividing line DL thus divides the blade element 12 or the refining surface 12' of the blade element 12 into two portions in such a way that the outer end zone 12*b* comprises all the second blade bars 20 which continuously extend up to or reach to the outer edge 14 of the blade element 12 and the inner end zone 12*b* does not comprise second blade bars 20 extending up to or reaching to the outer edge 14 of the blade element 12.

In the embodiment disclosed in FIGS. 3 and 4 the width of substantially all second blade bars 20 lying on the outer end portion 12*b* of the blade element 12 and extending up to or reaching up to the outer edge 14 of the blade element 12 is increasing in the direction toward the outer edge 14 of the blade element 12, i.e. is increasing in their longitudinal direction toward the outer edge 14 of the blade element 12. By "substantially all" is meant such an amount of the second blade bars 20 that the benefits of the solution in terms of reduced wear, longer lifetime etc., as disclosed in more detail later, are achieved. In practice it means that most, if not all, of the second blade bars 20 on the outer edge area 12*b* and extending up to the outer edge 14 have increasing width toward the outer edge 14, i.e. at least 50%, preferably 75-100%, more preferably 90% or more of the second blade bars 20. Below the width of the second blade bar 20 may be generally referred to with a reference sign W. In the outer end portion 12*b* of the blade element 12 the width W of those second blade bars 20 which do not extend to or reach to the outer edge 14 of the blade element 12 may remain constant or may increase in the direction toward the outer edge 14 of the blade element 12. The width of the second blade bars 20 lying on the inner end portion 12*a* of the blade element 12 may also remain substantially constant or may increase in their longitudinal direction toward the outer edge 14 of the blade element 12.

The above disclosed feature according to which the width W of the second blade bar 20 lying on the outer end portion 12*b* of the blade element 12 and extending to or reaching to the outer edge 14 of the blade element 12 is increasing in the direction toward the outer edge 14 of the blade element 12 is shown further in FIG. 4, which is an enlarged schematic view of a portion of the element 12 of FIG. 3. FIG. 4 shows a second blade bar 20 having a first end 20' and a second end 20", wherein the first end 20' of the second blade bar 20 is directed toward the inner edge 13 of the blade element 12 and the second end 20" of the second blade bar 20 is directed toward the outer edge 14 of the blade element 12. From FIG. 4 it can be seen that the width of the second blade bar 20 is arranged to increase toward the outer edge 14 of the blade element 12 in a longitudinal direction of the second blade bar 20, whereby a width W20" of the second blade bar 20 at the second end 20" of the second blade bar 20 is larger than a width W20' of the second blade bar 20 at the first end 20' of the second blade bar 20.

The increase in the width of the second blade bar 20 in its longitudinal direction toward the outer edge 14 of the blade element 12 may for example be 10 to 50%, preferably 30 to 40%.

Alternatively, or in addition to the feature according to which at least some of the second blade bars 20 lying on the outer end portion 12*b* of the blade element 12 have a width which is increasing in direction toward the outer edge 14 of the blade element 12, the blade element 12 may comprise a feature, according to which at least some of the second blade bars 20 lying on the outer end portion 12*b* of the blade element 12 have a width which is larger than a width of second blade bars 20 lying on the inner end portion 12*a* of the blade element 12. This feature of the blade element 12 is explained in more detail below and referring especially to FIG. 3.

In the blade element 12 disclosed, a width Wb of a second blade bar 20 lying at an outer end portion 12*b* of the blade element 12 is larger than a width Wa of a second blade bar 20 lying at an inner end portion 12*a* of the blade element 12.

The width Wa, Wb of the second blade bar 20 is determined as a dimension of the second blade bar 20 in a direction which is transversal to the direction of its extension or travel direction at the top surface of the first blade bar 18. If the second blade bar 20 has a constant width in its longitudinal direction, the width Wa, Wb of the second blade bar 20 corresponds to the value of that constant width. Alternatively, if the widths of the second blade bars 20 are increasing toward the outer edge 14 of the blade element 12, the width Wa, Wb of the second blade bar 20 corresponds to an average value for the width of that second blade bar 20, i.e. the average value of the width W20" of the second blade bar 20 at the second end 20" of the second blade bar 20 and the width W20' of the second blade bar 20 at the first end 20' of the second blade bar 20. Widths of the second blade bars 20 are thus arranged to increase in a direction from the inner edge 13 of the blade element 12 toward the outer edge 14 of the blade element 12 in such a way that widths of the second blade bars 20 lying at the outer end portion 12*b* of the blade element 12 are larger than widths of the second blade bars 20 lying at the inner end portion 12*a* of the blade element 12.

When the widths of at least some of the second blade bars 20 lying on the outer end portion 12*b* of the blade element 12 are increasing toward the outer edge 14 of the blade element 12, and/or when the widths of at least some of the second blade bars 20 lying on the outer end portion 12*b* of the blade element 12 are dimensioned to be larger than the widths of the second blade bars 20 lying on the inner end portion 12*a* of the blade element 12, the second blade bars 20 near the outer edge 14 of the blade element 12 provide an increased wear resistance, or in other words, compensate the increased wear rate appearing near the outer edge 14 of the blade element 12 during the operation of the refiner. This, in turn, provides that a shape of a profile of the blade gap 6 may remain substantially unchanged, whereby a contact between the blade bars in the opposite refining elements is less susceptible than with prior art blade elements, wherein the widths of the second blade bars near the outer edge of the blade element are equal to or smaller than the width of those near the inner edge of the blade element. The solution presented herein thus provides longer lifetime of the blade element than previously. The increase in the vibration level of the refiner may also now be avoided with worn blade elements too. Additionally, due to the solution disclosed, a taper grinding of the blade elements may also be omitted, the taper grinding being used nowadays to profile a blade gap so that, with disc refiners, the blade gap is lower near the outer circumference of the refining elements than it is in the vicinity of the center of the refining elements and, with cone refiners, the blade gap in the vicinity of the larger diameter end is lower than it is near the smaller diameter end. Thus, in the solution disclosed in this specification it is intended to take into account the increased wear of the blade bars close to the outer circumference of the refining elements in disc refiners and close to the end having a larger diameter in cone refiners so that the aforementioned taper grinding is no longer necessary.

In order to compensate for open area and hydraulic capacity requirements of the refining surface 12' of the blade element 12 a width of the second blade grooves 21 may be near the inner edge 13 of the blade element 12 larger than near the outer edge 14 of the blade element 12.

According to an embodiment, the widths of the second blade bars 20 may be arranged to increase stepwise in a direction from the inner edge 13 of the blade element 12 toward the outer edge 14 of the blade element 12 in such a way that the second blade bars 20 in a group of neighboring second blade bars 20 have an equal width but the widths of the second blade bars 20 in a group of neighboring second blade bars 20 lying closer to the outer edge 15 of the blade element 12 are larger than in another group or in other groups of neighboring second blade bars 20 lying farther off the outer edge 14 of the blade element 12. This embodiment is further clarified in FIG. 3, wherein reference sign 23 refers to a group of neighboring second blade bars 20, in which group 23 all the second blade bars 20 have the width Wb, and reference sign 22 refers to another group of neighboring second blade bars 20, which group 22 lies farther off the outer edge 14 of the blade element 12 and in which group 22 all the second blade bars 20 have the width Wa, the width Wa being smaller than the width Wb. In FIG. 3 the second blade bars 20 belonging to the groups 22, 23 of the neighboring second blade bars 20 are exemplary marked off with broken lines.

According to an embodiment, the widths of the neighboring second blade bars 20 may be arranged to increase continuously toward the outer edge 14 of the blade element 12 in such a way that in a direction of the first blade bar 18 toward the outer edge 14 of the blade element 12, or in other words, in the direction from the inner edge 13 of the blade element 12 toward the outer edge 14 of the blade element 12, the width of the next second blade 20 bar is larger than the width of the preceding second blade bar 20.

According to an embodiment, an increase in the width of the second blade bars 20 along an extension or a reach of the first blade bar 18, i.e. between the inner end portion 12*a* of the blade element 12 and the outer end portion 12*b* of the blade element 12 is 10 to 100%, preferably 10 to 50% and more preferably 30 to 40%.

According to an embodiment, the blade element is a planar-like blade element 12 intended to a disc refiner 10, and an increase in the width of the second blade bars 20 may be on the level of 0.5 mm to 0.7 mm. According to an embodiment like that the width of the second blade bar lying near the inner edge 13 of the blade element 12 may be in the range of about 1-2 mm, for example 1.5 mm, and it may remain constant until the beginning of the outer end portion 12*b* of the blade element 12 where the width of the second blade bars gradually increases until at the outer edge 14 of the blade element 12 the width may be on the range of about 1.5-2.7 mm, for example 2.2 mm, while the width of the second blade grooves 21 remain substantially constant. In another example the width of the second blade bars 20 is increased stepwise from about 1.5 mm close to the inner edge 13 of the blade element 12 to about 1.9 mm before the outer end portion 12*b* of the blade element 12, and further to 2-3 mm, preferably from about 2.2 to 2.5 mm in the region of the outer end portion 12*b*. The width increase in the outer end portion 12*b* of the blade element 12 is from 10 to 100%, preferably from 20 to 50%.

According to an example, the blade element is a conical blade element intended to a cone refiner 11, and an increase in the width of the second blade bars 20 is on the level of 0.1 mm to 0.3 mm. The width of the second blade bar 20 lying near the inner edge of the blade element may be arranged to vary between 1.3 mm and 1.4 mm, for example and the width of the second blade bar 20 lying near the outer edge of the blade element may be arranged to vary between 1.5 mm and 1.7 mm, for example. As a consequence of that, according to an embodiment like that the width of the second blade bar lying near the inner edge of the blade element may be 1.3 mm, for example, and the width of the second blade bar lying near the outer edge of the blade element may be 1.5 mm, for example. According to another embodiment like that the width of the second blade bar lying near the inner edge of the blade element may be 1.4 mm, for example, and the width of the second blade bar lying near the outer edge of the blade element may be 1.5 mm or 1.7 mm, for example.

Basically, the same blade bar and blade groove pattern as above is applicable for both conical and disc-like blade elements. Thus, the width increase may occur as gradually increasing width of individual second blade bars in the region of the outer end portion 12*b* only as well as stepwise increase starting already in the region of the inner end portion 12*b*. Due to its shape, increased width of the second blade bars 20 toward the outer edge 14 in the conical blade element often means that the width of the second blade grooves 21 is decreased toward the outer edge 14 of the blade element 12.

The embodiment of the blade element 12 shown in FIG. 3 is solid or uniform but it could also comprise openings extending through the blade element 12, whereby a feed of the material to be refined into the blade gap of the refiner may be provided through the openings in the blade element or a discharge of the material already refined away from the blade gap of the refiner may be provided through the openings in the blade element.

The blade element 12 disclosed herein may be utilized in all refining applications where the blade element structure comprising second blade bars 20 and second blade grooves 21 at the top surfaces of the first blade bars 18 is applicable. One application wherein the blade elements as disclosed herein are very useful is softwood refining, for it provides reduced fiber cutting at high refiner loads. Another suitable application area is low consistency refining of mechanical pulp, wherein the advantageous effect is also reduced fiber cutting at high refiner loads, resulting to higher strength of the material refined and paper and board manufactured from it. A third suitable application area is hardwood refining, wherein higher wear resistance due to increased second blade bar width close to the outer edge of the blade element provides clearly longer lifetime of the blade element than previously.

In the embodiments above, the solution is utilized in blade segments intended to provide a part of a complete refining surface of a refining element. The solution described could be utilized as well in blade elements which alone provide a complete refining surface of a refining element. Although in the embodiments above the features of the blade element are mainly described in connection with a disc-like blade element intended to be used in a disc refiner or with a conical blade element intended to be used in a cone refiner, the same refiner surface configuration could be utilized in drum refiners too. The ultimate refining surface configuration or pattern is specifically designed for each refining task and therefore the general layout of the blade bars and the blade grooves may vary from those disclosed above.

It will be obvious to a person skilled in the art that, as the technology advances, the inventive concept can be implemented in various ways. The invention and its embodiments are not limited to the examples described above but may vary within the scope of the claims.

The invention claimed is:

1. A blade element for a refiner for refining fibrous material, the blade element comprising:

an inner edge and an outer edge, first blade bars and first blade grooves therebetween, the first blade bars and the first blade grooves extending in a direction between the inner edge and the outer edge, toward the outer edge of the blade element;

wherein the first blade bars have top surfaces defined by second blade bars, the second blade bars defining second blade grooves therebetween;

wherein the first blade bars, the first blade grooves, the second blade bars, and the second blade grooves together provide a refining surface of the blade element;

wherein the blade element is divided by an imaginary dividing line spaced between the inner edge and the outer edge in the direction toward the outer edge of the blade element, so as to divide the blade element into an outer portion terminating at the outer edge, and an inner portion terminating at the inner edge, the outer portion and the inner portion meeting at the imaginary line;

wherein the second blade bars and the second blade grooves are at least partly transversal to the first blade bars, so that the second blade bars and the second blade grooves alternate in the direction toward the outer edge of the blade element;

wherein the first blade bars are united at the outer edge such that the first grooves do not extend to the outer edge;

wherein most of the second blade bars in the outer portion extend to the outer edge, and none of the second blade bars in the inner section terminate at the outer edge;

wherein at least some of the second blade bars lying on the outer portion of the blade element have a width which increases in the direction toward the outer edge of the blade element.

2. The blade element of claim 1 wherein at least some of the second blade bars lying on the outer portion of the blade element have a width which is larger than a width of the second blade bars lying on the inner portion of the blade element.

3. The blade element of claim 1 wherein the outer portion of the blade element covers a radial distance in the direction toward the outer edge of the blade element from a beginning of each unbroken and continuous second blade bar to the outer edge of the blade element so that the outer end portion includes the whole length of all the second blade bars which extend to the outer edge of the blade element.

4. The blade element of claim 1 wherein the width of at least 90% of all the second blade bars lying on the outer portion of the blade element increases in the direction toward the outer edge of the blade element.

5. The blade element of claim 1 wherein a width of at least some of the second blade bars lying on the inner portion of the blade element increases in the direction toward the outer edge of the blade element.

6. The blade element of claim 5 wherein the width of at least 90% of the second blade bars lying on the inner portion of the blade element increases in the direction toward the outer edge of the blade element.

7. The blade element of claim 4 wherein in the outer portion of the blade element the increase in the width of the second blade bar in the direction toward the outer edge of the blade element is 10 to 50%.

8. The blade element of claim 7 wherein in the outer portion of the blade element the increase in the width of the second blade bar in the direction toward the outer edge of the blade element is 30 to 40%.

9. The blade element of claim 1 wherein the width of the second blade bars lying on the outer portion of the blade element increase continuously toward the outer edge of the blade element in such a way that the width of a next second blade bar is larger than the width of a preceding second blade bar in a direction of the first blade bar toward the outer edge of the blade element.

10. The blade element of claim 1 wherein the blade element is a planar blade element for a disc refiner and that an increase in the width of the second blade bars in the outer portion of the blade element is 0.5 mm to 0.7 mm.

11. The blade element of claim 1 wherein the blade element is a conical blade element for a cone refiner and that an increase in the width of the second blade bars in the outer portion of the blade element is 0.1 mm to 0.3 mm.

12. The blade element of claim 1 wherein the width of the second blade bars in the inner portion of the blade element is arranged to vary between 1.3 mm and 1.4 mm and the width of the second blade bars in the outer portion of the blade element is arranged to vary between 1.5 mm and 1.7 mm.

13. A blade element for a refiner for refining fibrous material, the blade element comprising:

an inner edge and an outer edge, first blade bars and first blade grooves therebetween, the first blade bars and the first blade grooves extending in a direction between the inner edge and the outer edge, toward the outer edge of the blade element;

wherein the first blade bars have top surfaces defined by second blade bars, the second blade bars defining second blade grooves therebetween;

wherein the first blade bars, the first blade grooves, the second blade bars, and the second blade grooves together provide a refining surface of the blade element;

wherein the blade element is divided by an imaginary dividing line spaced in between the inner edge and the outer edge in the direction toward the outer edge of the blade element, so as to divide the blade element into an outer portion terminating at the outer edge, and an inner portion terminating at the inner edge, the outer portion and the inner portion meeting at the imaginary line;

wherein the second blade bars and the second blade grooves are at least partly transversal to the first blade bars, so that the second blade bars and the second blade grooves alternate in the direction toward the outer edge of the blade element;

wherein the first blade bars are united at the outer edge such that the first grooves do not extend to the outer edge;

wherein the outer portion of the blade element covers a radial distance from a beginning of each unbroken and continuous second blade bar to the outer edge of the blade element; and wherein at least some of the second blade bars lying on the outer portion of the blade element have a width which is larger than a width of the second blade bars lying on the inner portion of the blade element.

14. The blade element of claim 13 wherein an increase in the width of the second blade bars between the second blade bars lying on the outer portion of the blade element and the second blade bars lying on the inner portion of the blade element is 10-100%.

15. The blade element of claim 14 wherein an increase in the width of the second blade bars between the second blade bars lying on the outer portion of the blade element and the second blade bars lying on the inner portion of the blade element is 10 to 50%.

16. The blade element of claim 15 wherein an increase in the width of the second blade bars between the second blade bars lying on the outer portion of the blade element and the second blade bars lying on the inner portion of the blade element is 30 to 40%.

17. The blade element of claim 13 wherein the width of at least some of the second blade bars lying on the outer portion of the blade have a width which increases in the direction toward the outer edge of the blade element in such a way that the width of a next second blade bar is larger than the width of a preceding second blade bar in a direction of the first blade bar toward the outer edge of the blade element.

18. The blade element of claim 14 wherein the width of the second blade bars in the inner blade portion of the blade element is 1-2 mm and the width of the second blade bars in the outer portion of the blade element is 1.5-2.7 mm.

19. A refiner for refining fibrous material wherein the refiner comprises:

at least one blade element comprising:

an inner edge and an outer edge, first blade bars and first blade grooves therebetween, the first blade bars and the first blade grooves extending in a direction between the inner edge and the outer edge, toward the outer edge of the blade element;

wherein the first blade bars have top surfaces defined by second blade bars, the second blade bars defining second blade grooves therebetween;

wherein the first blade bars, the first blade grooves, the second blade bars, and the second blade grooves together provide a refining surface of the blade element;

wherein the blade element is divided by an imaginary dividing line spaced in between the inner edge and the outer edge in the direction toward the outer edge of the blade element, so as to divide the blade element into an outer portion terminating at the outer edge, and an inner portion terminating at the inner edge, the outer portion and the inner portion meeting at the imaginary line;

wherein the outer portion of the blade element covers a radial distance from a beginning of each unbroken and continuous second blade bar to the outer edge of the blade element; and wherein the second blade bars and the second blade grooves are at least partly transversal to the first blade bars, so that the second blade bars and the second blade grooves alternate in the direction toward the outer edge of the blade element;

wherein the first blade bars are united at the outer edge such that the first grooves do not extend to the outer edge; and wherein least some of the second blade bars lying on the outer portion of the blade element have a width which increases in a direction toward the outer edge of the blade element.

20. The refiner for refining fibrous material of claim 19 wherein the width of at least 90% of all the second blade bars lying on the outer portion of the at least one blade element increases continuously in the direction toward the outer edge of the blade element.

* * * * *